United States Patent [19]

Harandi et al.

[11] Patent Number: 4,997,543

[45] Date of Patent: Mar. 5, 1991

[54] REDUCTION OF BENZENE IN GASOLINE

[75] Inventors: Mohsen N. Harandi, Lawrenceville; Hartley Owen, Belle Mead, both of N.J.

[73] Assignee: Mobil Oil Corporation, Fairfax, Va.

[21] Appl. No.: 570,987

[22] Filed: Aug. 22, 1990

Related U.S. Application Data

[63] Continuation of Ser. No. 287,300, Dec. 21, 1988, abandoned.

[51] Int. Cl.[5] ..... C10G 51/02

[52] U.S. Cl. ..... 208/49; 208/66; 208/67; 208/79

[58] Field of Search ..... 208/49, 66, 67, 79

[56] References Cited

U.S. PATENT DOCUMENTS

| | | | |
|---|---|---|---|
| 4,016,218 | 4/1977 | Haag et al. | 585/467 |
| 4,140,622 | 2/1979 | Herout et al. | 208/93 |
| 4,209,383 | 6/1980 | Herout et al. | 208/93 |
| 4,358,362 | 11/1982 | Smith et al. | 208/91 |
| 4,358,363 | 11/1982 | Smith | 208/111 |
| 4,446,007 | 5/1984 | Smith | 208/111 |
| 4,648,957 | 3/1987 | Graziani et al. | 208/58 |
| 4,858,103 | 8/1989 | Harandi | 208/58 |

OTHER PUBLICATIONS

Kirk-Othmer, Encyclopedia of Chemical Technology, Third Edition, vol. 2, John Wiley & Sons, New York (1978), pp. 59-61.

Oil and Gas Journal 75(23), 165-170 (1977).

Oil and Gas Journal 76(21), 78-86 (1978).

1986 Refining Process Handbook, pp. 89-90 (Hydrocarbon Processing, Sep. 1986).

*Primary Examiner*—Curtis R. Davis

*Attorney, Agent, or Firm*—Alexander J. McKillop; Charles J. Speciale; Laurence P. Hobbes

[57] ABSTRACT

The benzene concentration in the gasoline pool of a petroleum refinery is decreased by alkylation of the benzene in a catalytic dewaxing reactor using the olefinic by-products from the dewaxing reaction as alkylating agents. The catalytic dewaxing is preferably carried out in the presence of an intermediate pore size zeolite such as ZSM-5 using a distillate or lube boiling range dewaxing feed. The benzene rich feed preferably contains less than about 2% $C_{7+}$ aromatics in order to reduce alkylation of non-objectionable species in the reformate.

18 Claims, 1 Drawing Sheet

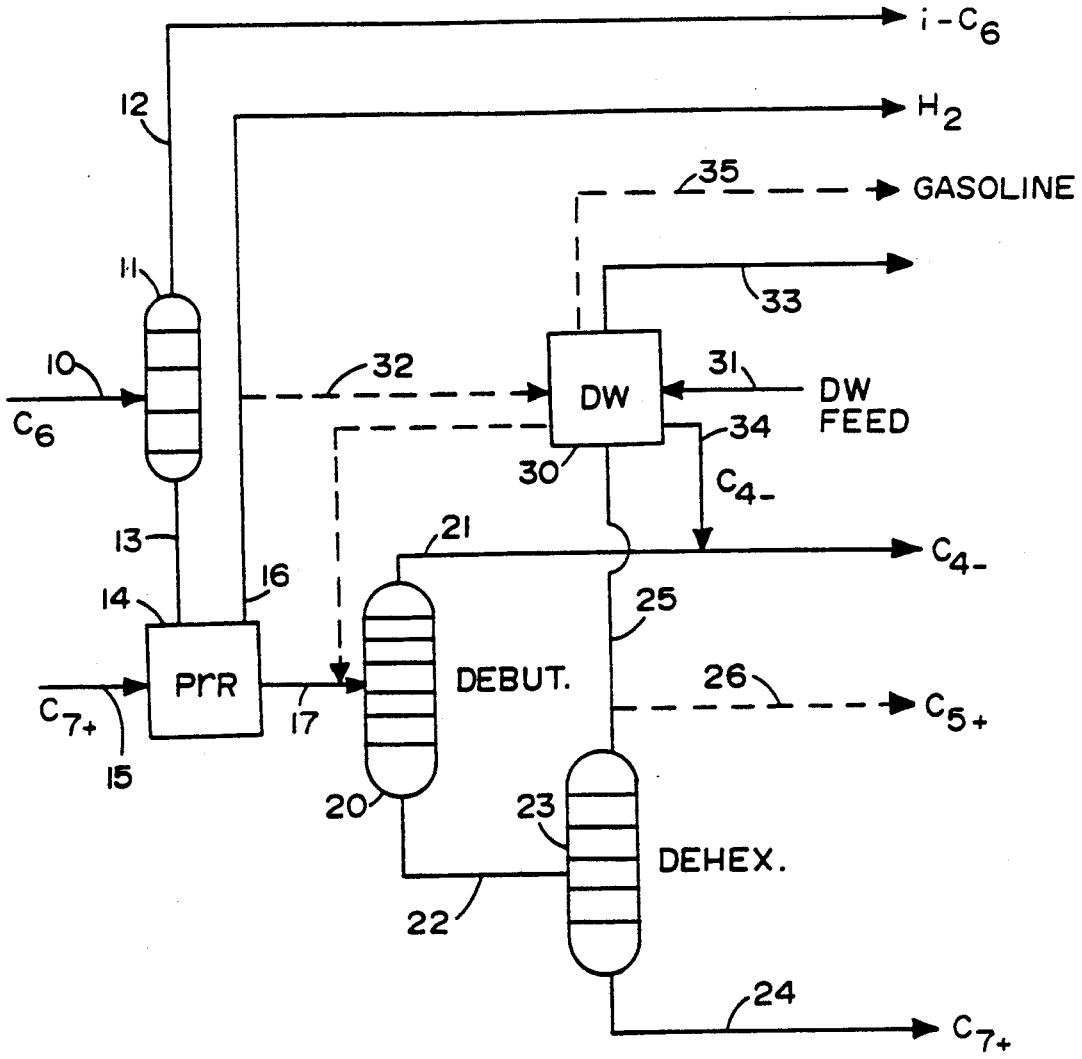
i-C6
H2
GASOLINE
12
35
11
33
10
32
31
DW
DW
FEED
C6
34
30
C4-
13
21
C4-
16
14
25
PrR
DEBUT.
26
C5+
C7+
17
15
20
23
DEHEX.
22
24
C7+

REDUCTION OF BENZENE IN GASOLINE

This is a continuation of copending application Ser. No. 287,300, filed on Dec. 21, 1988 and now abandoned.

FIELD OF THE INVENTION

This invention relates to a process for reducing the concentration of benzene in the gasoline pool of a petroleum refinery. It also provides a method for increasing the octane rating of the gasoline by-product from a dewaxing process.

BACKGROUND OF THE INVENTION

The demand for gasoline as a motor fuel is one of the major factors which dictates the design and mode of operation of a modern petroleum refinery. The gasoline product from a refinery is derived from several sources within the refinery including, for example, gasoline from the catalytic cracking unit, straight run gasoline, reformate and gasoline obtained as a low boiling by-product from various refinery operations, especially catalytic processes such as catalytic dewaxing. The octane number of the gasoline from these different sources varies according to the nature of the processing and the octane rating of the final gasoline pool will depend upon the octane ratings of the individual components in the pool as well as the proportions of these components. The increasing use of unleaded gasoline coupled with increasing engine efficiencies in road vehicles has led to a demand for increased gasoline pool octane which, in turn, makes it desirable to increase the octane values of the individual components of the pool. Although there are various ways of achieving this objective, some necessarily involve compromises which may render them less attractive in commercial refinery operation. For example, the octane rating of FCC gasoline may be improved by operating the cracker at a higher temperature (conventionally measured at the top of the riser); similarly, reformate octane may be increased by operating the reformer at higher severity but in both cases, a yield loss will ensure. In the case of by-product gasoline from catalytic dewaxing processes it may be possible to improve octane during the start-up by increasing the temperature rapidly to a value higher than normal, as described in U.S. Pat. No. 4,446,007 (Smith), However, the use of higher temperatures in dewaxing processes will also tend to decrease the yield of dewaxed products. Alternative measures for increasing pool octane are therefore still desirable.

Another trend which is perceptible in the petroleum refining industry is towards the reduction of benzene is the gasoline pool. In the United States, the Environmental Protection Agency is considering regulation of the gasoline content and similar measures are being considered in the European Community. Benzene is particularly prevalent in reformer gasoline, being a distinctive product of the reforming process, produced by the dehydrogenation of $C_6$ cycloparaffins, the dehydrocyclization of straight chain paraffins of appropriate chain length ($C_6$) and dealkylation of other aromatics. It is produced in particularly high concentration in the continuous catalytic reforming process which is currently replacing the conventional cyclic reforming process in the industry. It would be possible to reduce the benzene content of the reformate by a simple fractionation process but because the boiling point of benzene is close to that of other desirable and unobjectionable components of the reformate, this too would lead to a considerable loss in yield.

Fortunately, the alkyl benzenes such as toluene are considered less objectionable than benzene itself and, in addition, posses good octane ratings so that they may be readily incorporated into the refinery gasoline pool. Alkylation of the undesired benzene component therefore represents an attractive means for dealing with the benzene problem while, at the same time, providing a potential for improvement in the octane rating of the gasoline pool.

SUMMARY OF THE INVENTION

We have now devised a processing scheme which is capable of reducing the benzene concentration in the refinery gasoline pool while, at the same time, providing a way of upgrading the octane rating of by-product gasoline from another refinery process. According to the present invention, a benzene rich fraction from a petroleum refinery stream is alkylated in a catalytic dewaxing unit. The benzene rich fraction is preferably obtained from a reformer effluent stream and after removal of $C_7$+aromatics and other heavier components, is subjected to alkylation by the olefinic light hydrocarbons which are formed as byproducts of a catalytic dewaxing process. The catalytic dewaxing process is preferably a distillate or lube dewaxing process employing an intermediate pore size zeolite as a dewaxing catalyst, preferably zeolite ZSM-5.

THE DRAWINGS

In the accompanying drawings, the single FIGURE is a simplified schematic flowsheet of the present combined dewaxing-alkylation process.

DETAILED DESCRIPTION

In the present process a benzene rich fraction obtained from a petroleum refinery stream is alkylated in a catalytic dewaxing reactor by means of the light olefinic fragmets formed as by-products from the catalytic dewaxing process. The preferred source of the benzene rich fraction is a reformate i.e., a refinery stream which has been subjected to catalytic reforming, preferably over a reforming catalyst containing platinum. Other refinery streams containing significant quantities of benzene and with a suitable boiling range of about $C_5$ to 400° F. ($C_5$ to about 203° C.), usually $C_5$ to 330° F. ($C_5$ to about 165° C.) may, however, be used. Reformates usually contain $C_6$ to $C_8$ aromatic hydrocarbons and $C_5$ to $C_6$ paraffinic hydrocarbons with the aromatic hydrocarbons being constituted mainly by benzene, toluene, xylene and ethyl benzene. Compositions for reformates which may be used in the present process are shown in Table 1 below:

TABLE 1

| | Reformate Composition | | |
|---|---|---|---|
| | Broad | Intermediate | Narrow |
| Specific Gravity | 0.72 to 0.88 | 0.76 to 0.88 | 0.76 to 0.83 |
| Boiling Range, °F. | 60 to 400 | 60 to 400 | 80 to 390 |
| °C. | 15 to 205 | 15 to 205 | 27 to 200 |
| Mole % | | | |
| Benzene | 5 to 60 | 5 to 40 | 10 to 30 |
| Toluene | 5 to 60 | 10 to 40 | 10 to 40 |
| $C_8$ Aromatic(1) | 5 to 60 | 5 to 50 | 5 to 15 |

(1)Xylene and ethyl benzene component.

The composition of a typical reformer stream from a platinum reforming process is given in Table 2 below.

TABLE 2

| Reformate Composition | Mol. Pct. |
|---|---|
| $C_4$ | 0.2 |
| $C_5$ | 15.5 |
| Non-arom. $C_6$ | 10.2 |
| Benzene | 25.8 |
| Non-arom. $C_7$ | 0.2 |
| Toluene | 34.9 |
| $C_8$ aromatics | 10.2 |
| $C_9$ aromatics | 3.0 |

As may be seen from the above the above figures, the benzene constitutes a significant proportion of the reformate stream and if no measures are taken to remove it, it will pass into the refinery gasoline pool unchanged. The present method provides a convenient way of coverting the benzene to alkyl aromatics which are not objectionable environmentally and which contribute to yeild as well as octane in the gasoline pool.

During the reforming process it is the n-hexane and iso-hexanes which are converted to benzene by dehydrocyclization and in addition, any cyclo-hexane present is converted to benzene by dehydrogenation. The iso-hexanes, however, are of relatively high octane rating and can therefore be passed directly to the gasoline pool if a severe reduction of the benzene is required. In such cases, the iso-hexanes should be separated from the reformer feed and should bypass the reformer so as to minimize benzene formation at this stage. Thus, the reformer feed should be iso-dehexanized prior to entering the reformer with the separated iso-hexanes being passed directly to the gasoline pool. In addition, the alkylating capacity of the catalytic dewaxing unit is usually rather limited in comparison to the volume of the reformate available since the light olefinic components produced from the dewaxing reactions form a relatively minor part of the dewaxed effluent (typically, less than 30 weight percent of the effluent). Because of this, the presence of alkylatable aromatic species other than benzene in the fraction which is fed to the dewaxing unit for alkylation should be limited so that the available olefins will be reserved for reaction with the benzene. The reformate should therefore be fractionated to remove $C_{7+}$aromatics. This, coupled with the removal of the isohexane fraction prior to the reformer, ensures that a large proportion of the $C_{7-}$stream from the reformer contains significant quantities of benzene which are then subjected to alkylation in the dewaxing unit.

A minor proportion of paraffins in the $C_{7-}$fraction may undergo cracking in the dewaxing reactor to produce more light olefins for benzene alkylation while reducing the paraffin content of the light reformate, to produce a further improvement in gasoline octane. Incremental reductions in benzene may also be obtained by increasing dewaxing severity to produce more olefins or adding an additional aromatics alkylating agent such as methanol to the dewaxing reactor.

Catalytic dewaxing is, by now, an established refinery process and has achieved widespread utility in the dewaxing of the distillate fuel fraction as well as in the dewaxing of lubricant fractions. Catalytic dewaxing processes are described in "Industrial Application of Shape Selective Catalysis", Chen and Garwood, *Catal. Rev.-Sci. Eng.*, 28 (2 and 3) 185-264 (1986), see especially 241-247. Catalytic dewaxing processes are also disclosed in U.S. Pat. Nos. 3,700,585 which describes the use of ZSM-5 for dewaxing various petroleum feedstocks. Patents describing catalytic dewaxing processes include U.S. Pat. Nos. 3,852,189, 3,891,540, 3,894,933, 3,894,938, 3,984,939, 3,926,782, 3,956,102, 3,968,024, 3,980,550, 4,067,797, 4,192,734, 4,446,007, 4,358,363, 4,358,362, to which reference is made for descriptions of typical catalytic dewaxing process using intermediate pore size zeolite dewaxing catalysts. Catalytic dewaxing processes of this type are in commercial operation and the Mobil Distillate Dewaxing process (MDDW) has achieved significant success for the dewaxing of various distillate materials including straight run and catalytically cracked distillates and gas oils. See 1984 *Refining Process Handbook*, p. 87, also Hydrocarbon Processing, 58 No. 5 pp. 119–122. The Mobil Lube Dewaxing process (MLDW) has also achieved technological maturity, providing the means for producing high quality lubricants of low pour point. See 1986 *Refining Process Handbook (Hydrocarbon Processing, September* 1986) p. 90.

The MDDW and MLDW process employ intermediate pore size zeolite dewaxing catalysts such as ZSM-5. Another dewaxing process employing zeolite beta, a zeolite of different type and structure, is disclosed in U.S. Pat. No. 4,419,220 (LaPierre). This process, known as MIDW,may also be used for reformate upgrading since the zeolite beta dewaxing catalyst used in it is also able to mediate the benzene alkylation reaction.

The present reformate upgrading process is particularly useful with the distillate dewaxing process (MDDW), employing an intermediate pore size zeolite such as ZSM-5 as the dewaxing catalyst and a distillate boiling range feed which is catalytically dewaxed, usually in the presence of hydrogen, typically at temperatures from about 300° to 850° F. (about 150° to 455° C.), hydrogen partial pressures from about 100 to 4000 psig (about 790 to 27680 kPa abs), a space velocity of about 0.1 to 10 LHSV and hydrogen/oil ratio of at least 1000 SCF/BBL about 180 n.l.l.$^{-1}$) ($H_2$:dewaxing feed). The high pressures characteristic of this process tend to minimize cracking of paraffins and aromatics in the benzene-rich feed stream. The distillate boiling range feed will typically have a boiling range within the range of 400° to 1000° F. (about 205° to 540° C.), more usually 500° to 1000° F. (about 260° to 540° C.) and may typically be a straight run, desulfurized or catalytically cracked distillate or gas oil, for example, distillate fuels including kerosene, jet fuel, fuel oil, and heating oil.

The lube dewaxing process (MLDW) employing intermediate pore size zeolite dewaxing catalysts also represents a preferred dewaxing process for use in the present upgrading scheme. Compared to the distillate dewaxing process, the lube dewaxing process operates at relatively low temperatures and high pressures so that the extent to which paraffins and aromatics entering the dewaxing reactor are cracked is relatively low. Because of this, it may be desirable in some cases to send a full range reformate stream to this reactor.

Lube dewaxing processes are described in U.S. Pat. Nos. 4,749,467 (Chen), 4,181,598 (Gillespie), 4,137,148 (Gillespie), 4,376,036 (Garwood), 4,222,855 (Pelrine), 4,176,050 (Chen), 4,296,166 (Gorring), and 4,229,282 (Peters). A dewaxing process using a synthetic offretite catalyst is disclosed in U.S. Pat. No. 4,259,174 (Chen). Reference is made to these patents for descriptions of suitable lube dewaxing processes.

Typical process conditions for lube dewaxing over an intermediate pore size zeolite dewaxing catalyst such as ZSM-5 are temperatures from about 500° to 700° F. (about 260° to 370° C.), with the end-of-cycle temperature preferably not exeeding about 670° F. (about 355° C.) for good product stability, pressures from 400–800 psig (about 2860 to 5620 kPa abs), hydrogen:oil ratios of 1000 to 4000 SCF/bbl, usually 2000 to 3000 SCF/bbl of liquid feed (about 180 to 710, usually about 355 to 535 n.l.l.$^{-1}$) and a space velocity (LHSV) from 0.25 to 5.0 hr$^{-1}$, usually 0.5 to 2 hr$^{-1}$.

Feeds for the MLDW process may include a wide range of lube boiling range materials e.g. 650° F.+ (about 345° C.+) fractions such as light, intermediate or heavy neutral lube fractions as well as residual fractions e.g. bright stock. Usually the lube will have been subjected to an initial solvent extraction step to remove undesirable aromatic components e.g. with phenol, furfural or N-methylpyrrolidone and accordingly, lube feeds will usually be 650° F. + (345° C.+) raffinates.

The relatively low temperature and high pressures of the lube dewaxing process are favorable since cracking of paraffins and/or aromatics entering the reactor with the benzene fraction will be held at a relatively low level. The distillate dewaxing process operating at high pressure also tends to minimize cracking of the paraffins and aromatics entering the reactor. In cases such as these it may be desirable to employ a full range reformate as the feed.

The catalytic dewaxing reactions which take place in the dewaxing reactor in the presence of the zeolite dewaxing catalyst proceed by shape-selective cracking reactions which are selective for the straight chain and near-straight chain waxy components of the feed. The cracking produces olefinic products, most of which are concentrated in the naphtha or lighter boiling ranges. These olefins will react with the benzene to form alkylaromatic species, mostly within the gasoline boiling range, usually 200° F.+ (about 93° C. + ). The acidic dewaxing catalyst readily mediates the alkylation reaction under the conditions prevailing in the dewaxing reactor.

The dewaxing processes operating at pressures generally in the range of about 10 to 1000 psig (about 170 to 7000 kPa) ($H_2$ partial pressure) with operating temperatures typically from 500° to 850° F. (about 260° to 455° C.) at reactor inlet, are particularly effective for promoting benzene alkylation. The optimum operating temperature range for benzene alkylation is about 300° to 425° F. at a typical benzene:olefin ratio of about 6.6:1 (molar, benzene:ethylene), within the typical operating temperature rate for the dewaxing processes described above. Benzene conversion is typically 10–60% per pass within this temperature range while the corresponding olefin conversion will usually be at least 60 percent, usually over 90 percent at these temperatures. Operational constraints of the dewaxing process e.g. need to meet target pour point, may, however, require the use of a higher temperature than the optimum for the alkyation reaction.

The yield of alkylated aromatics will vary according to the benzene:olefin ration with higher yields favored by higher benzene:olefin ratios up to the limit of olefins available for alkylation. Normally, the preferred weight ratio is from about 0.5:1–500:1, most preferably 10:1–50:1 (benzene:olefin, by weight).

The benzene rich fraction derived from the reformate or other refinery streams is admitted to the dewaxing reactor where it undergoes alkylation by the light olefins, principally in the gasoline and $C_4$- boiling range, formed by the shape selective dewaxing reactions which occur in the reactor. The product of the reactions are alkyl aromatics which are less objectionable than benzene and which possesses, moreover, good octane rating for blending into the refinery gasoline pool. Thus, not only is the benzene rendered innocuous but it is converted to desirable products and in addition, the relatively low octane value gasoline produced as a by-product of the dewaxing process is converted to a higher octane blending component for the refinery gasoline pool. Addition of the benzene-rich fraction to the dewaxer also tends to minimize the overall reaction exotherm, prolonging dewaxer cycle duration if a fixed bed process is used. The light gas make of the dewaxing process is also reduced while increasing gasoline yield as well as the hydrogen purity of the circulating gas used in the fixed bed process.

The preferred zeolites for carrying out the present catalytic dewaxing/upgrading process are the intermediate pore size zeolites, that is, zeolites which posses a constraint index of 1 to 12. These zeolites preferably have a silica/alumina ratio of at least 12:1, as described in U.S. Pat. No. 4,016,218 (Haag). Zeolites which may be used in the manner described above are ZSM-5, ZSM-11, ZSM-12, ZSM-23, ZSM-35, ZSM-38 and ZSM-48 all of which are known materials, as discussed in U.S. Pat. Nos. 4,106,218 and 4,446,007 (Smith). Zeolite beta may also be used, as described in U.S. Pat. No. 4,419,220 (LaPierre).

Normal reactor configuration for the dewaxing process may be employed, preferably downflow trickle bed reactors with a fixed bed of the zeolite catalyst. It is not contemplated that the suuperimposition of the alkylation reaction on the conventional dewaxing reactions will complicate or degrade the operation of the dewaxing step and in fact, improvements may be expected since the olefins produced by the shape-selective cracking reactions characteristic of the dewaxing process may undergo polymerization and/or aromatization reactions which result in the formation of high molecular weight coke precursors and, eventually, coke in the presence of the metal components which are frequently present on the dewaxing catalyst to promote catalyst deactivation. Removal of these olefins by alkylation may assist in preventing formation of the coke precursors, with a consequent beneficial effect upon catalyst cycle life.

A simplified schematic flowsheet of the present process is shown in the figure. A $C_6$ feed fraction containing iso-hexane is introduced by way of conduit 10 to iso-dehexanizer 11 in which the iso-hexanes are separated as overhead and passed through line 12 as an acceptable, high octane component to the refinery gasoline pool. The remainder of the $C_6$ feed, including paraffins and naphthenes is passed through line 13 into platinumn catalytic reformer 14 together with a $C_{7+}$ naphtha feed introduced through conduit 15. Hydrogen-riches gases evolved in the course of the characteristic reforming reactions in platinum reformer 14 pass out through line 16 and the reformate through line 17 to debutanizer 20. The $C_{4-}$ gases from the debutanizer leave as overhead through line 21 to pass to the reformer gas plant. Debutanizer bottoms pass through line 22 to dehexanizer 23 to form a $C_{7+}$ bottoms fraction which is removed through line 24. The light $C_{5+}$ reformate containing substantial quantities of benzene, passes out as overhead through line 25 to catalytic dewaxing unit 30. A portion of the light reformate may be withdrawn through conduit 26.

A waxy feed e.g. distillate or lube raffinate, is introduced into the catalytic dewaxer through inlet 31; hydrogen may be supplied from the reformer by means of line 32 connected to reformer off-gas line 16. The dewaxed product from the dewaxer e.g. low pour point distillate or lube is removed through outlet 33. $C_4$- effluent from the dewaxer passes through line 34 to be combined with the light ends from the debutanizer in line 21. The gasoline boiling range fraction from the dewaxer, including alkyl aromatic components produced by the alkyation of benzene (from dehexanizer 23) with olefinic dewaxing products, passes out through effluent line 35. An unstabilized gasoline product may be passed through the ancillary equipment by way of line 36. The light ends from this fraction are removed in debutanizer 20 with the alkylaromatic component and other $C_{7+}$ materials removed as dehexanizer bottoms; unreacted benzene is then recycled together with fresh benzene from the reformer.

We claim:

1. A process for upgrading a benzene-rich fraction derived from a refinery stream which comprises introducing the benzene-rich fraction into a catalytic dewaxing zone in which a waxy hydrocarbon stream is catalytically dewaxed in the presence of an acidic dewaxing catalyst, and alkylating the benzene in the fraction with olefins produced by the catalytic dewaxing of the waxy hydrocarbon stream in the presence of the zeolite dewaxing catalyst in the presence of hydrogen, wherein the catalytic dewaxing and alkylation are carried out in the presence of hydrogen at the hydrogen/oil ratio of 1000 to 5000 SCF/BBL ($H_2$:dewaxing feed) and a space velocity of 0.1 to 10 LHSV and a pressure of 400 to 1000 psig ($H_2$ partial pressure).

2. A process according to claim 1 in which the refinery stream comprises a reformate.

3. A process according to claim 2 in which the benzene rich fraction comprises a reformate from which the $C_{7+}$ components have been removed by fractionation.

4. A process according to claim 3 in which the benzene rich fraction comprises a $C_6$ fraction of a reformate from which the $C_{7+}$ and $C_{5-}$ components have been removed.

5. A process according to claim 4 in which the reformate is obtained by the reforming of a de-isohexanized naphtha with the reformer effluent being subjected to fractionation to remove $C_{7+}$ components.

6. A process according to claim 1 in which the catalytic dewaxing comprises the catalytic dewaxing of a distillate hydrocarbon fraction having a boiling range in the range of 400° to 1000° F.

7. A process according to claim 1 in which the catalytic dewaxing comprises the catalytic dewaxing of a lubricant fraction having an initial boiling point of at least 650° F.

8. A process according to claim 6 in which the catalytic dewaxing is carried out in the presence of hydrogen in the presence of an intermediate pore size zeolite dewaxing catalyst.

9. A process according to claim 7 in which the intermediate pore size dewaxing catalyst is ZSM-5 .

10. A process for catalytically dewaxing a waxy hydrocarbon distillate fraction having a boiling range in the range of 400° to 1000° F. and for simultaneously upgrading a benzene rich fraction derived from a petroleum refinery stream which comprises:

(i) catalytically dewaxing the waxy petroleum fraction by contacting the fraction in a catalytic dewaxing zone with an intermediate pore size zeolite dewaxing catalyst at a temperature from 300° to 850° F. in the presence of hydrogen to form a dewaxed effluent and olefinic by-product;

(ii) introducing the benzene-rich fraction into the catalytic dewaxing zone with the waxy petroleum fraction and alkylating the benzene component of the benzene rich fraction by means of the olefinic by-products of the dewaxing reaction in the presence of the dewaxing catalyst;

(iii) separating a gasoline boiling range product including alkylated benzene components produced by the alkylation of the benzene from the dewaxed hydrocarbon fraction and (iv) recovering the separated dewaxed hydrocarbon fraction and the gasoline boiling range fraction;

said process being further characterized by carrying out the catalytic dewaxing and alkylation in the presence of hydrogen at a hydrogen/oil ratio of 1000 to 5000 SCF/BBL ($H_2$:dewaxing feed) and a space velocity of 0.1 to 10 LHSV and a pressure of 400 to 1000 psig ($H_2$ partial pressure).

11. A process according to claim 10 in which the refinery stream comprises a reformate.

12. A process according to claim 11 in which the benzene rich fraction comprises a reformat from which the $C_{7+}$components have been removed by fractionation.

13. A process according to claim 12 in which the benzene rich fraction comprises a $C_6$ fraction of a reformate from which the $C_{7+}$and $C_{5-}$components have been removed.

14. A process according to claim 13 in which the reformate is obtained by the reforming of a de-isohexanized naphtha with the reformer effluent being subjected to fractionation to remove $C_{7+}$components.

15. A process according to claim 10 in which the catalytic dewaxing comprises the catalytic dewaxing of a distillate hydrocarbon fraction having a boiling range in the range of 400° to 1000° F.

16. A process according to claim 10 in which the catalytic dewaxing comprises the catalytic dewaxing of a lubricant fraction having an initial boiling point of at least 650° F.

17. A process according to claim 15 in which the catalytic dewaxing is carried out in the presence of hydrogen in the presence of an intermediate pore size zeolite dewaxing catalyst.

18. A process according to claim 16 in which the intermediate pore size dewaxing catalyst is ZSM-5.

* * * * *